US005228247A

United States Patent [19]

Dressler

[11] Patent Number: 5,228,247

[45] Date of Patent: Jul. 20, 1993

[54] GUTTER GUARD FERRULE

[75] Inventor: Robert D. Dressler, Mechanicsburg, Pa.

[73] Assignee: Alumax Aluminum Corp., Lancaster, Pa.

[21] Appl. No.: 7,712

[22] Filed: Jan. 22, 1993

[51] Int. Cl.[5] ..... E04D 13/00

[52] U.S. Cl. ..... 52/12; 248/48.1; 16/2; 411/546

[58] Field of Search ..... 52/12, 95, 11; 248/48.1, 48.2; 16/2, 108, 109; 411/546, 441, 488, 367, 371, 547, 498

[56] References Cited

U.S. PATENT DOCUMENTS 2,144,225 1/1939 Neisworth ..... 248/48.1
3,340,653 9/1967 Steeg ..... 248/48.2 X
3,915,418 10/1975 D'Amato ..... 248/48.2
4,294,423 10/1981 Rowe ..... 248/48.2
5,098,223 3/1992 Schoenherr et al. ..... 248/48.1 X

FOREIGN PATENT DOCUMENTS 7614 5/1932 Australia ..... 248/48.1
21050 of 1909 United Kingdom ..... 52/11

*Primary Examiner*—Rodney M. Lindsey
*Attorney, Agent, or Firm*—Hartman Underhill & Brubaker

[57] ABSTRACT

A ferrule for use in a rain gutter to surround a spike which connects the gutter to a supporting wall, with the gutter beneath an overhanging roof edge. The ferrule has a bore formed with internal longitudinal ribs angularly spaced from each other to define channels. The spike has corners which fit into the channels whereby the ferrule is held against rotation relative to the spike.

7 Claims, 1 Drawing Sheet

GUTTER GUARD FERRULE

FIELD OF INVENTION

This invention relates to an improved ferrule for use in a rain gutter to surround and protect a spike which connects the gutter to a supporting structure.

BACKGROUND

In rain gutter structures, ferrules have been provided for the mounting spikes of the gutter. Gutters are in the form of troughs having vertically extending inside and outside walls connected by a bottom wall. Rain coming off a roof overhanging the gutter is discharged into the trough for horizontal travel to a vertically extending downspout for deposit of the water onto the ground.

The gutters may be made of galvanized metal, aluminum, plastic or other material. Gutters are mounted on a vertical side wall of the structure by spikes at spaced intervals along the length of the gutter. Each spike passes through the outside wall of the gutter, across the trough and through the gutter inside wall. The spike is hammered into the building or other structure that has the gutter.

Each spike has an enlarged head. The objective is to drive the spike until the head abuts against the outside of the gutter wall, but not beyond such point. If the installer is unskilled, the spike may be driven too far which will result in the gutter becoming dented.

Commonly a ferrule is provided through which an associated spike passes. The length of the ferrule used is such that it traverses the space between the inside and outside walls of the gutter. Conventionally, gutters come in widths of four inches or five inches. The ferrule length is thus four inches or five inches to span the space between the walls of the gutter.

Gutter ferrules have been made of sheet metal, galvanized and various plastic materials. Each ferrule assists in limiting the penetration of its associated spike into the structure wall. But if the spike is hit too hard by a hammer, the ferrule may become bent or driven into one or both of the walls of the gutter. Damage to the gutter may occur.

SUMMARY OF INVENTION

One object of this invention is to provide an improved plastic ferrule through which a gutter spike is adapted to be projected, the ferrule having means to resist bending, being relatively rigid longitudinally.

Another object of this invention is to provide an improved plastic gutter ferrule which is cylindrical on its outside and has longitudinal ribs in the bore of the ferrule to strengthen the part against bending and provide an enlarged surface at each end of the ferrule to stop penetration of the associated spike into the wall of the structure on which the gutter is mounted.

A further object of this invention is to provide a gutter ferrule for a spike having longitudinal corners which fit into channels formed in the bore of the ferrule whereby rotational movement of the ferrule relative to the spike is prevented by engagement of the ferrule with the spike.

Other objects of the invention will be apparent hereafter according to the following specifications.

DRAWINGS

DESCRIPTION

Figure 1:
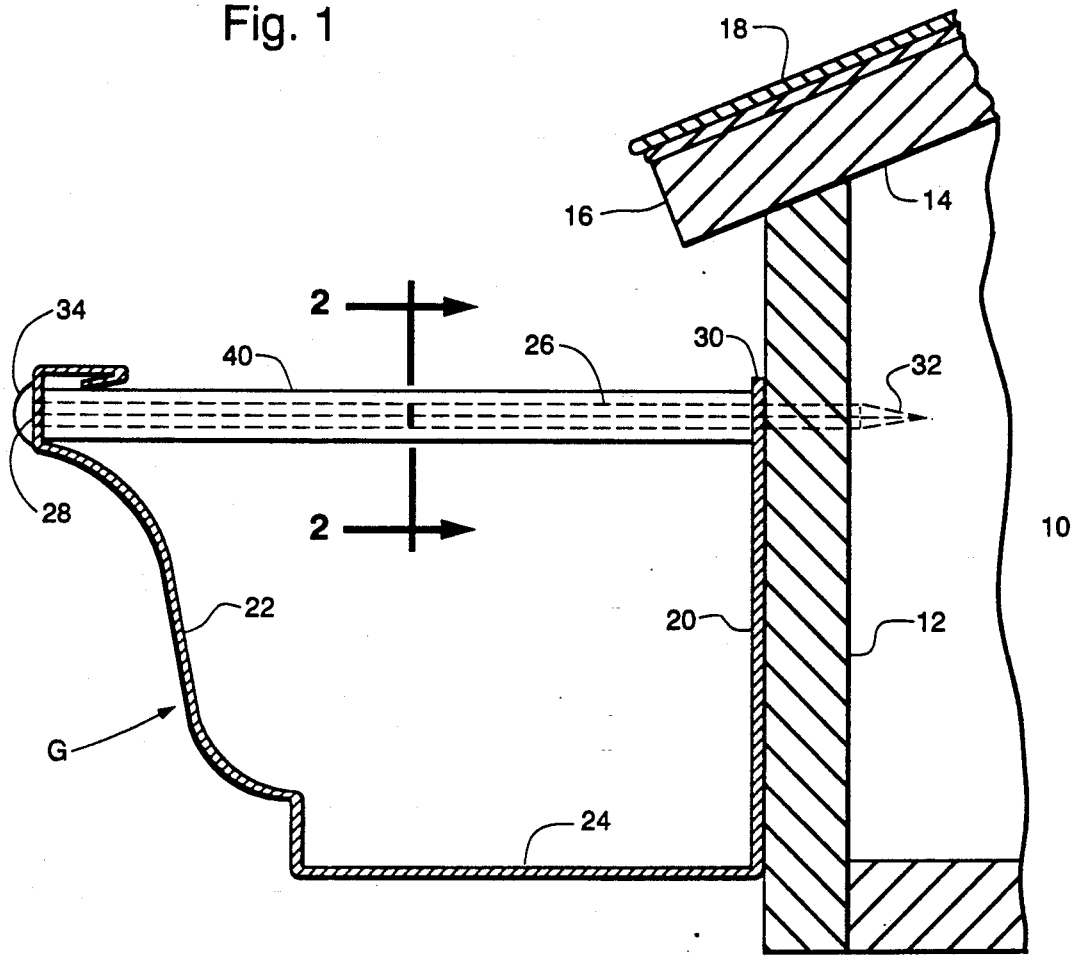
FIG. 1 is a vertical cross-section of a structure having a rain gutter beneath an overhanging roof, the gutter being mounted by a spike which projects through a plastic ferrule constructed according to this invention.

Referring now to the drawing by numerals of reference, 10 denotes a building structure having a vertical side wall 12. Supported on wall 12 is a slanted roof 14 having an end 16 which extends laterally of wall 12. On top of the roof are shingles 18.

Beneath the overhanging end 16 of roof 14 is a rain gutter G having a vertical inside wall 20, a shaped outside wall 22, the walls 20 and 22 being connected by bottom wall 24 to form a horizontal gutter trough.

Gutter G is attached to the wall 12 of structure 10 by a spike 26, usually made of aluminum. It is understood that there is a spike at spaced intervals along the length of the gutter to mount the gutter in place. Spike 26 projects through the upper outer end 28 of outside wall 22, across the width of gutter G and then through the upper inner end 30 of wall 20. The spike has a pointed end 32 adapted to be projected through upright wall 12 to fasten the gutter in place. At its opposite end, spike 26 has an enlarged head 34 which engages the outer surface of wall 22 at end 28.

Spike 26 passes through an extruded plastic ferrule 40 having an exact length to traverse the space between the walls of a standard gutter. This space is conventionally four inches or five inches. The particular ferrule used matches the gutter width. As shown in FIG. 1 ferrule 40 traverses the space between the inside and outside walls of the gutter, 20 and 22.

Ferrule 40 is cylindrical, in the form of a tube. It is of uniform diameter from end to end. The outer surface is smooth and unbroken. Internally, ferrule 40 has a bore 42. Within bore 42, the ferrule is formed with four ribs 44 ninety degrees apart. These ribs extend longitudinally from one end of the ferrule to the other, each having a wide arcuate outer end 46 and a rounded, narrower inner end 48, see FIG. 2.

Figure 3:
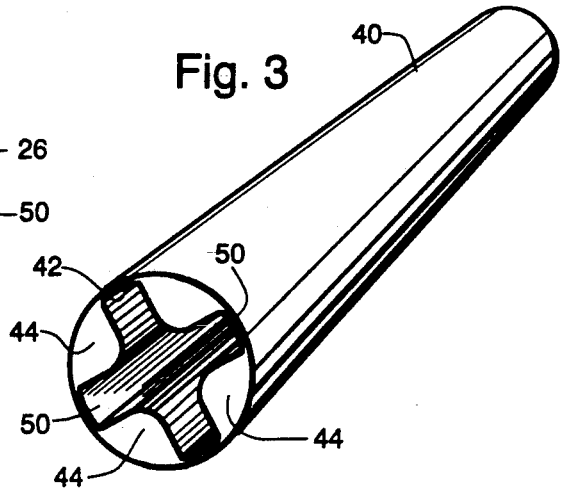
FIG. 3 is a perspective view showing one end of the ferrule and the gutter engagable surface provided by the ribs at the end of the ferrule.

The ribs in ferrule 40 form four equally spaced channels 50 also ninety degrees apart, see FIG. 3.

Figure 2:
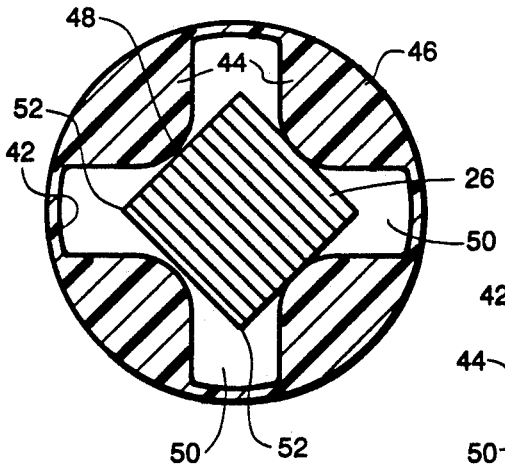
FIG. 2 is an enlarged cross-section taken on the line 2—2 of FIG. 1 looking in the direction of the arrows showing the ribs formed in the bore of the ferrule and the engagement therewith of the spike which passes through the ferrule.

As shown in FIG. 2, spike 26 is square in cross-section, having four corners 52, one of which fits into each of the channels 50 between the ferrule ribs 44. The distances between the inner ends 48 of the ribs 44 is such that a space is provided wide enough to easily receive the spike 26. The spike projects through the ferrule 40 when the corners 52 of the spike are in register with the channels 50.

With this design, a gutter G is mounted by projecting the pointed end 32 of the spike 26 through the upper end 28 of the wall 22 and then through the plastic ferrule 40. After projecting through ferrule 40, the pointed end 32 of the spike passes through the upper end 30 in a wall 22 of the gutter G. The installer applies hammer blows to the head 34 of spike 26 whereby the pointed end is projected into and through the wall 12 of structure 10.

When the head 34 of the spike 26 comes into engagement with the upper end 28 of the outer wall 22, the travel of the spike is brought to a stop by ferrule 40 extending between the gutter walls 20 and 22. The enlarged ends of ferrule 40, formed by the ends of the ribs 44 provides a broad surface area at each end of the ferrule. The enlarged surface areas help to prevent damage of the gutter walls as the spike is driven into place.

The projection of spike 26 is thus limited by its associated ferrule 40. Denting of the gutter by driving the spike 26 too far is prevented. The ribs 44 in ferrule 26 strengthen the part. Bending of the ferrule is resisted and the ferrule provides a stop which limits the travel of the spike.

When assembled, ferrule 40 is locked against rotation by engagement of the corners 52 of the spike with the ribs 44 in the bore 42 of the ferrule and by the clamping force on the ferrule between the gutter walls 20 and 22.

Rain water traveling down shingles 18 of the slanted roof 14 drops freely into gutter G. The water will pass over the smooth outer cylindrical surface of ferrule 40. There is no contact of the water with the mounting spike 26. Ferrule 40 protects the spike from corrosion. At the same time, the ferrule offers no resistance to the passage of water downwardly into the gutter G.

Although the gutter ferrule of this invention has been described in connection with a spike which is square in cross-section and four ribs and channels being provided, modifications could be made in the structure without departing from the concept disclosed.

Having thus described my invention, what I claim is:

1. A ferrule for use in a rain gutter wherein the gutter is adapted to be connected to a vertical wall board of a structure with the gutter disposed beneath an overhanging roof edge from which water passes into the gutter to be directed to a downspout, the gutter having an inside wall against the wall board, an outside wall, and between which is a bottom wall which defines a trough with said inside and outside walls, and a spike to connect the gutter to the wall board, said spike extending through the outer gutter wall across the gutter and then through said inner gutter wall and into said wall board, said spike having a head adapted to engage said outer wall and a body formed with longitudinal parallel corners extending along the length of the spike, said ferrule comprising a tube having a bore formed with internal longitudinal ribs spaced angularly from each other and defining channels between adjacent ribs, each channel being adapted to receive one corner of said spike, said spike being fixed against rotation by its projection into said wall board of the structure and said ferrule being held against rotation by engagement of said spike corners with said ribs.

2. A ferrule for use in a rain gutter as recited in claim 1 wherein the ferrule is formed of plastic material, the periphery of the ferrule being cylindrical and said ribs projecting radially inwardly into the bore of the ferrule.

3. A ferrule for use in a rain gutter as recited in claim 2 wherein said spike is square in cross section, having four right angle corners, said ribs inside said ferrule being angularly spaced ninety degrees apart and forming four spaced channels, each of which receives one corner of said spike.

4. A ferrule for use in a rain gutter as recited in claim 3 wherein each of said ribs has a rounded inner surface, the projection of said ribs into the bore of the ferrule being such that a space is provided to receive said spike with the corners thereof within the channels of the ferrule.

5. A ferrule as recited in claim 2 wherein said ribs extend from one end of the ferrule to the other and provide end walls with an enlarged surface area whereby when said spike is driven through the outside and inside walls of the rain gutter the travel of the spike into said wall board is stopped on engagement of said spike head with the gutter outer wall, the increased end areas of the ferrule preventing damage to the outside and inside walls of the gutter.

6. A rain gutter adapted to be connected to a vertical wall board of a structure with the gutter disposed beneath an overhanging roof edge from which water passes into the gutter to be directed to a downspout, comprising:

a trough having an inside wall, an outside wall and a bottom wall connecting said inside and outside wall;

a spike square in cross section and extending through said outside wall, across said trough, through said inside wall and into said wall board;

said spike having a head engageable with said outside wall to limit the projection of the spike into said wall board;

an extruded plastic ferrule through which said spike is projected, the ferrule having a length which traverses the space between said outside and inside walls of said trough;

said ferrule having a cylindrical periphery and having ribs extending radially inwardly into a bore of the ferrule;

said ribs being located ninety degrees apart extending from one end of the ferrule to the other and forming four channels each adapted to receive one corner of said spike;

and said spike being held against rotation by its projection into said vertical wall board of the structure and said ferrule being restricted against rotation by engagement of said ribs with the spike.

7. A rain gutter as recited in claim 6 wherein said ribs in said ferrule extend parallel to each other for the length of the ferrule and provide enlarged ends on the ferrule which engage said inner and outer walls of the gutter to limit the projection of said spike into the structure without damage to the gutter walls.

* * * * *